US007841216B2

(12) United States Patent
Uhlin

(10) Patent No.: US 7,841,216 B2
(45) Date of Patent: Nov. 30, 2010

(54) DRY CLEANING MACHINE AND DRIVING UNIT COMPARTMENT

(75) Inventor: Goran Uhlin, Lagan (SE)

(73) Assignee: Aktiebolaget Electrolux, Stockholm (SE)

( * ) Notice: Subject to any disclaimer, the term of this patent is extended or adjusted under 35 U.S.C. 154(b) by 635 days.

(21) Appl. No.: 11/445,779

(22) Filed: Jun. 2, 2006

(65) Prior Publication Data

US 2007/0277562 A1 Dec. 6, 2007

(30) Foreign Application Priority Data

Apr. 10, 2006 (SE) ..... 0600798

(51) Int. Cl.
*D06F 43/02* (2006.01)

(52) U.S. Cl. ..... 68/5 C; 68/140

(58) Field of Classification Search ..... 68/140, 68/5 R, 5 C, 18 C, 207; 8/142
See application file for complete search history.

(56) References Cited

U.S. PATENT DOCUMENTS 2,539,407 A 1/1951 Dinley
6,148,647 A 11/2000 Kabeya et al.
6,351,973 B1 * 3/2002 McClain et al. ..... 68/140
6,460,382 B1 * 10/2002 Kim et al. ..... 68/140
6,484,738 B1 * 11/2002 Andrews et al. ..... 134/201
6,564,594 B1 * 5/2003 Ito et al. ..... 68/24
2001/0052250 A1 * 12/2001 Uhlin et al. ..... 68/12.26
2002/0059817 A1 * 5/2002 Heyder et al. ..... 68/140

FOREIGN PATENT DOCUMENTS

GB 2261828 A * 6/1993

OTHER PUBLICATIONS

European Search Report for EP 07716071, dated Feb. 23, 2009, 2 pages.

* cited by examiner

*Primary Examiner*—Joseph L Perrin
(74) *Attorney, Agent, or Firm*—Pearne & Gordon LLP

(57) ABSTRACT

A cleaning machine, such as a laundry cleaning machine, includes a treatment compartment housing that defines a treatment compartment and a driving unit compartment housing that defines a driving unit compartment. The driving unit compartment housing is connected to the treatment compartment housing such that the driving unit compartment housing can be removable from the treatment compartment housing to access the driving unit compartment from outside the treatment compartment.

20 Claims, 4 Drawing Sheets

DRY CLEANING MACHINE AND DRIVING UNIT COMPARTMENT

BACKGROUND OF THE INVENTION

1) Field of the Invention

The present invention relates to a cleaning machine, such as a laundry cleaning machine having a treatment compartment housing and a driving unit compartment housing.

2) Description of Prior Art

Cleaning machines, which are used with non-aqueous cleaning mediums such as dry cleaning machines, for use with densified liquid treatment gas, for example carbon dioxide, are known. Such cleaning machines are usually equipped with a treatment chamber in which a drum is rotatably arranged for receiving objects to be cleaned, such as laundry, and a driving unit, which is operable to rotate the drum. In conventional cleaning machines, the driving unit is placed outside of the treatment chamber and acts on a shaft of the drum passing though a wall of the treatment chamber. Since it is difficult to properly seal the rotating shaft due to the high pressure inside the treatment chamber, the driving unit of more recent machines is placed inside the treatment chamber. The drum of the cleaning machine should be easily accessible for loading and unloading the laundry. Therefore the driving unit is usually located behind the drum in the treatment chamber of the cleaning machine.

A problem associated with these known cleaning machines is that the drum has to be removed in order to enable access to the driving unit, for example a motor and possibly a transmission, for service purposes or repairs. This is a time consuming and tedious operation, especially for machines running with densified liquid state treatment gas, such as carbon dioxide, where the components are robust and correspondingly heavy in order to withstand the high pressure in such machines. Furthermore, after removing the drum, the driving unit can only be reached through the washing chamber of the machine. Since the washing chamber usually is very narrow for an operator to crawl into, if at all possible, the access to the driving unit may nevertheless be restricted.

BRIEF SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, a cleaning machine, such as a laundry cleaning machine, includes a treatment compartment housing that defines a treatment compartment and a driving unit compartment housing that defines a driving unit compartment. The driving unit compartment housing is connected to the treatment compartment housing such that the driving unit compartment housing can be removable from the treatment compartment housing to access the driving unit compartment from outside the treatment compartment.

In accordance with another aspect of the present invention, a cleaning machine is provided. The cleaning machine includes: a treatment compartment having a drum rotatably disposed therein; a driving unit compartment having a motor disposed therein, the driving unit compartment being coupled to a wall of the treatment compartment; and a seal provided between the treatment compartment and the driving unit compartment. The motor is coupled to the drum via a rotatable shaft which extends between the treatment compartment and the driving unit compartment. Thus, the driving unit compartment can be removed from the treatment compartment such that the motor can be accessed without entry into the treatment compartment.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

BRIEF DESCRIPTION OF THE DRAWINGS

The invention may be performed in many different ways, and by way of example only, embodiments thereof will now be described in detail with reference being made to the accompanying drawings.

DESCRIPTION OF EXAMPLE EMBODIMENTS

Figure 1:
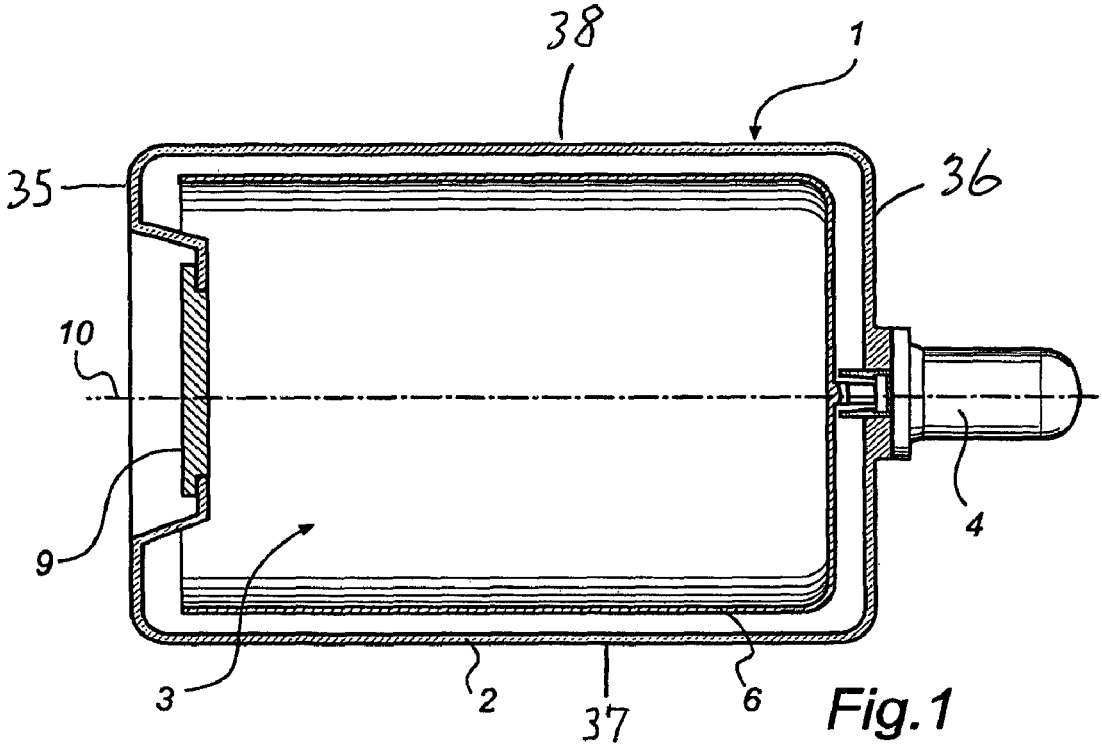
FIG. 1 is a schematic longitudinal sectional view of a cleaning machine according to a first embodiment of the invention.

The present invention relates to a cleaning machine and will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention can be practiced without these specific details.

Figure 3:
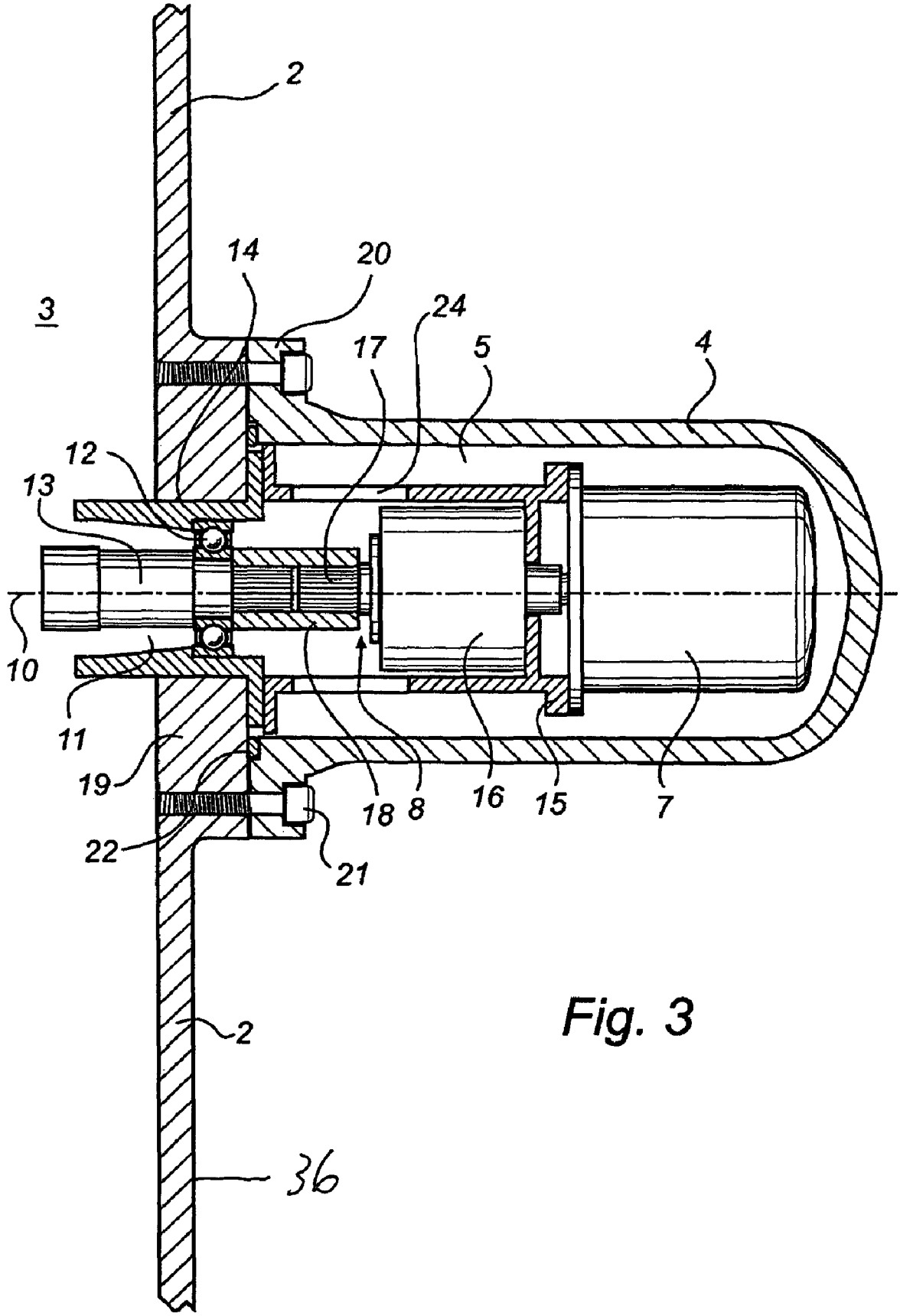
FIG. 3 is a schematic longitudinal sectional view of a driving unit compartment and an adjacent portion of a treatment compartment of the cleaning machine according to the first embodiment of the invention.

With reference to FIGS. 1 and 3, a cleaning machine 1 in the form of a laundry dry cleaning machine adapted to be used with liquefied carbon dioxide according to a first embodiment of the invention is shown.

The cleaning machine 1 comprises a fluid tight pressure vessel defined by a treatment compartment housing 2 defining a treatment compartment 3. The treatment compartment housing includes a front wall 35, a back wall 36 and side walls 37, 38. The cleaning machine also includes a driving unit compartment housing 4 defining a driving unit compartment 5. A drum 6 is rotatably arranged in the treatment compartment 3. A driving arrangement, including a motor 7 and a transmission arrangement 8, is connected to and operable to rotate the drum 6. The motor 7 is arranged in the driving unit compartment 5 and the transmission arrangement 8 extends from the motor 7 in the driving unit compartment 5 to the drum 6 in the treatment compartment 3. At a front end of the cleaning machine, the treatment compartment housing 2 is provided with a laundry opening for loading/unloading the drum 6. The laundry opening is closable by a door 9 in a fluid and pressure tight manner.

The driving unit compartment 5 is connected to the treatment compartment 3 such that there is fluid communication between them. The fluid communication is realized by a fluid communication opening 11 at a rear end of the treatment compartment housing 2, which forms a passage for fluid between the treatment compartment 3 and the driving unit compartment 5. The fluid communication opening 11 is also a transmission opening through which the transmission arrangement 8 extends. A seat 19 is provided around the fluid communication opening 11 on the outside of the treatment compartment housing 2.

The drum 6 is arranged to rotate about a horizontal central axis 10. A rotating shaft 13 of the drum 6 is supported in the fluid communication opening 11 by a bearing arrangement 12. Thus, the fluid communication opening 111 is located at approximately half the height of treatment compartment 3. Since the cleaning machine is adapted to operate with a level of carbon dioxide liquid up to one third of the height of treatment compartment 3, the fluid communication opening 11 is located above the maximal liquid level of the cleaning machine. Nevertheless, a sealing ring 14 is arranged in the fluid communication opening 11 for obstructing liquid flow but permitting gas flow between the treatment compartment 3 and the driving unit compartment 5. Thus, the driving unit compartment 5 and the treatment compartment 3, above the liquid level, are filled with carbon dioxide gas and have essentially the same pressure.

A cylindrical support structure 15 is attached to the treatment compartment housing 2 on the outside of the treatment compartment 3 beside the fluid communication opening 11 such that the support structure 15 surrounds the rim of the fluid communication opening 11. Thus, the support structure 15 is mounted to the treatment compartment housing 2 inside the driving unit compartment 5. In the driving unit compartment 5, the driving unit 7 is mounted to the free end of the support structure 15. A gearing arrangement 16, which is part of the transmission arrangement 8, is connected to the driving unit 7 mounted to the inside of the cylindrical support structure 15. An output shaft 17 of the gearing arrangement 16 is connected to the rotating shaft the drum 6 by means of a shaft-coupling 18. Thus, axis of rotation 10 of the drum 6 is aligned with components 7, 8 of the driving arrangement. Furthermore, the driving unit compartment housing 4 forms a protrusion centrally on the rear wall of the treatment compartment housing 2. The size of the driving unit compartment 5 is substantially less than the size of the treatment compartment 3.

The driving unit compartment housing 4 has a hoodlike shape. The hoodlike driving unit compartment housing 4 comprises a cylindrical main body and a hemispherical distal end. Around a circular entrance opening at the proximal end, the hoodlike driving unit compartment housing 4 is provided with an outward facing circular flange 20. The circular flange 20 is removably connected to the seat 19 by bolts 21. A liquid and pressure tight sealing in the form of an o-ring 22 is arranged between the flange 20 and the seat 19.

The driving unit 7 and the other parts of the driving arrangement that are arranged on the outside of the treatment compartment housing 2 are covered by the hoodlike, cylindrical driving unit compartment housing 4, which thus defines the driving unit compartment 5. The driving unit compartment housing 4 is positioned such that the axis of rotation 10 of the drum 6 is in line with the central axis of the cylindrical driving unit compartment housing 4. The round cylindrical shape of the driving unit compartment housing 4 is favorable with regard to withstanding the high pressure of a carbon dioxide cleaning machine.

Finally, the cleaning machine according to the first embodiment includes a closing member comprising the entire driving unit compartment housing 4. Thus, the opening for accessing the driving unit compartment 5 corresponds to the delimitation of the driving unit compartment housing 4.

According to an aspect of the invention, the driving unit compartment 5 of the first embodiment of the invention can be accessed in the following way. The cleaning machine is emptied of the carbon dioxide fluid and the bolts 21 are unscrewed. Thereafter the closing member in form of the hoodlike driving unit compartment housing 4 is removed. Due to the limited size of the driving unit compartment 5, the driving unit compartment housing/closing member 4 has a weight of approximately 30 Kg. After the removal, the motor 7 is fully exposed and accessible from all sides except from the wall of the treatment compartment housing 2. Furthermore, the gearing arrangement 16 of the transmission arrangement 8 can be accessed through holes 24 in the support structure 15. Since the driving arrangement is supported in the fluid communication opening 11 and by the support structure 15, any service or repair work can be readily performed.

When the inspection is finished, the driving arrangement is inserted through the entrance opening of the closing member in form of the hoodlike driving unit compartment housing 4. The driving unit compartment housing 4 is then passed over the projecting parts of the driving arrangement and secured to the treatment compartment housing 2 by the bolts 21. The sealing 22 ensure the liquid and pressure tight closing of the pressure vessel housing 1.

Figure 2:
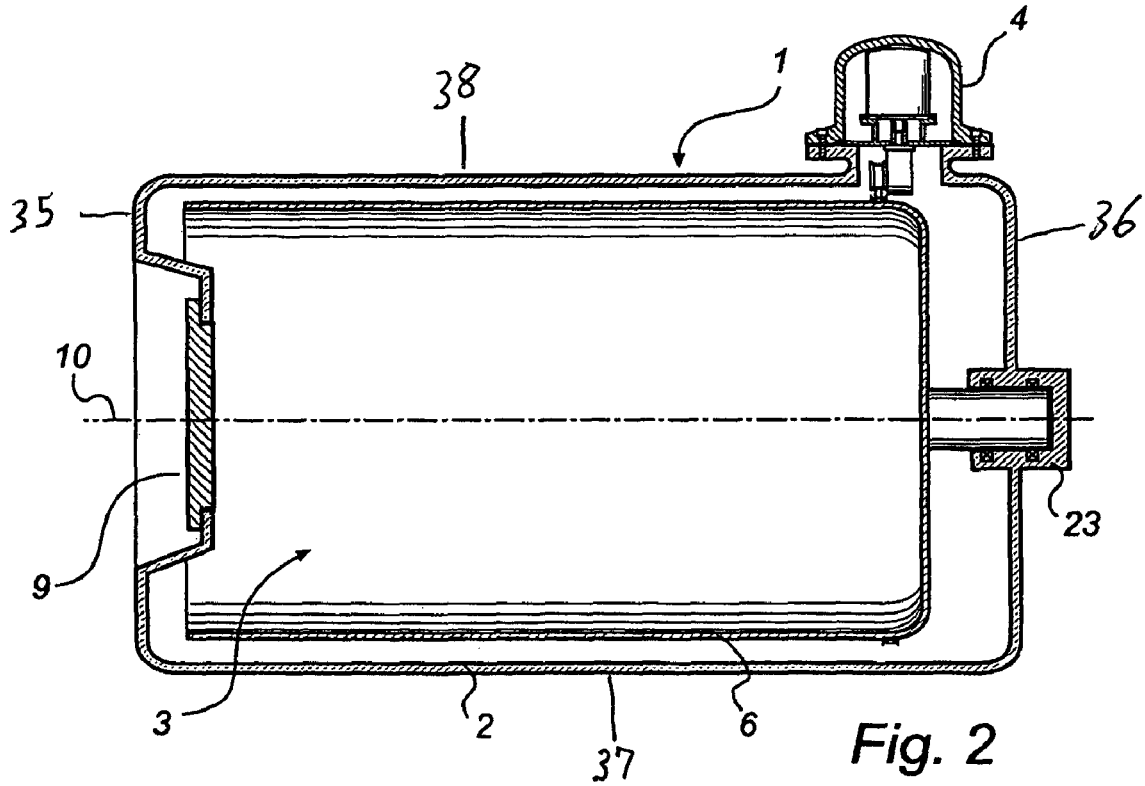
FIG. 2 is a schematic sectional view in the longitudinal direction of a cleaning machine according to a second embodiment of the invention.
Figure 4:
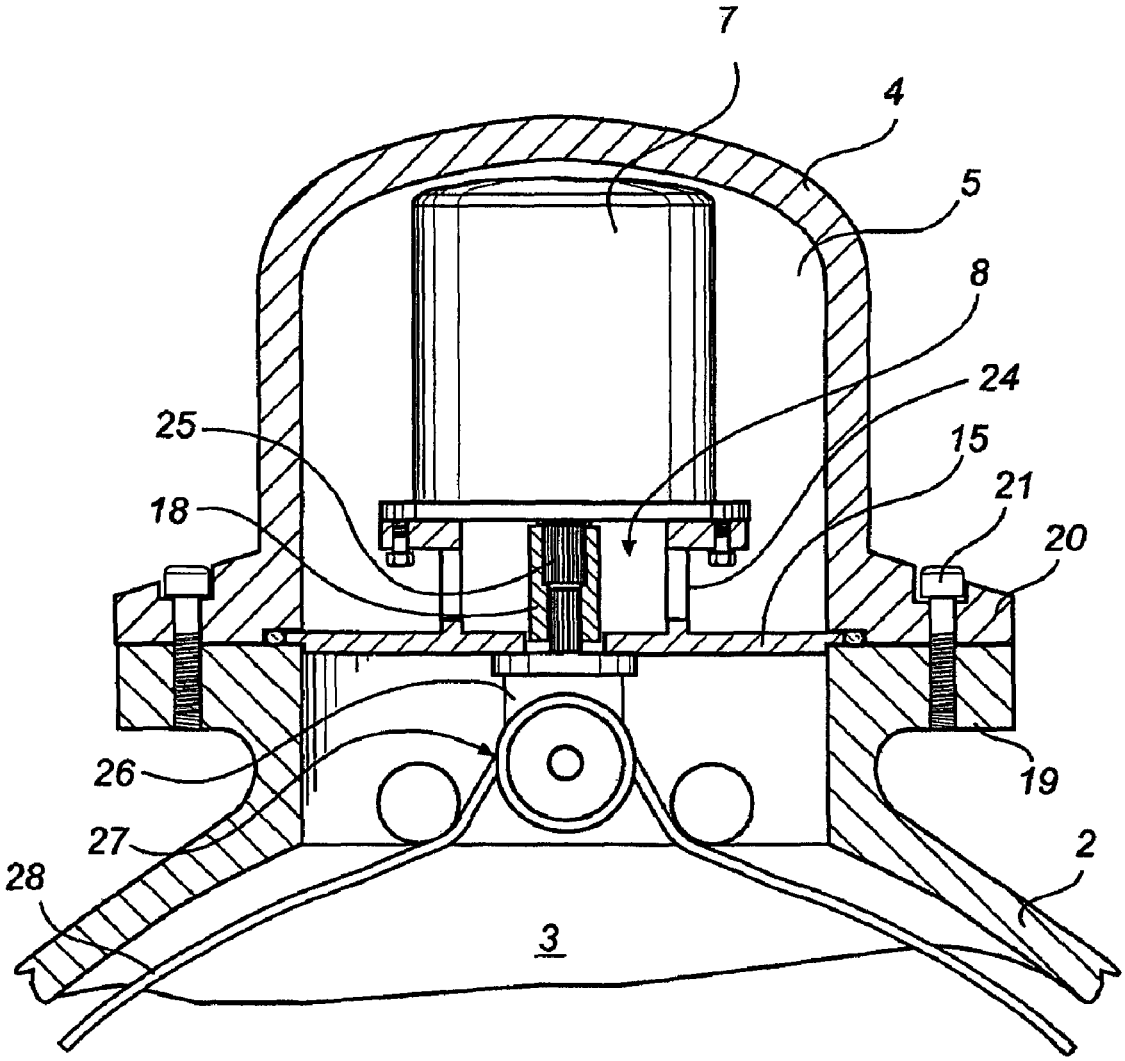
FIG. 4 is a schematic longitudinal sectional view of a driving unit compartment and portion of a treatment compartment of the cleaning machine according to the second embodiment of the invention.

In FIGS. 2 and 4 a second embodiment of the cleaning machine according to an aspect of the invention is shown. In FIGS. 2 and 4, those components that correspond to components shown in FIGS. 1 and 3 have the same reference numerals. The embodiment according to FIGS. 2 and 4 differs from the first embodiment described above substantially only in that the driving unit compartment housing 4 is arranged protruding from the top side of the treatment compartment housing 2 at a rear end thereof and in the layout of the driving arrangement.

The fluid communication between the driving unit compartment 5 the treatment compartment 3 is realized by a fluid communication opening 11 in the top wall of the treatment compartment housing 2. Thus, the fluid communication opening 11 is located as far as possible from the level of carbon dioxide liquid in the cleaning machine. The fluid communication opening 11 is also a transmission opening through which the transmission arrangement 8 extends.

A cylindrical support structure 15 is attached to the treatment compartment housing 2 on the outside of the treatment compartment 3 over the fluid communication opening 11. In the driving unit compartment 5, the motor 7 is mounted to the support structure 15 at the driving unit compartment side thereof. An outgoing shaft 25 of the motor 7 is connected to an angle gear 26 being part of a transmission arrangement 8 by means of a shaft-coupling 18. The angle gear 26 is connected to the support structure 15 at the treatment compartment side thereof. In the treatment compartment 3 the angle gear is connected to a belt driving arrangement 27. The belt 28 of the belt driving arrangement 27 is passed around the drum 6 for rotating the drum 6.

Figure 5:
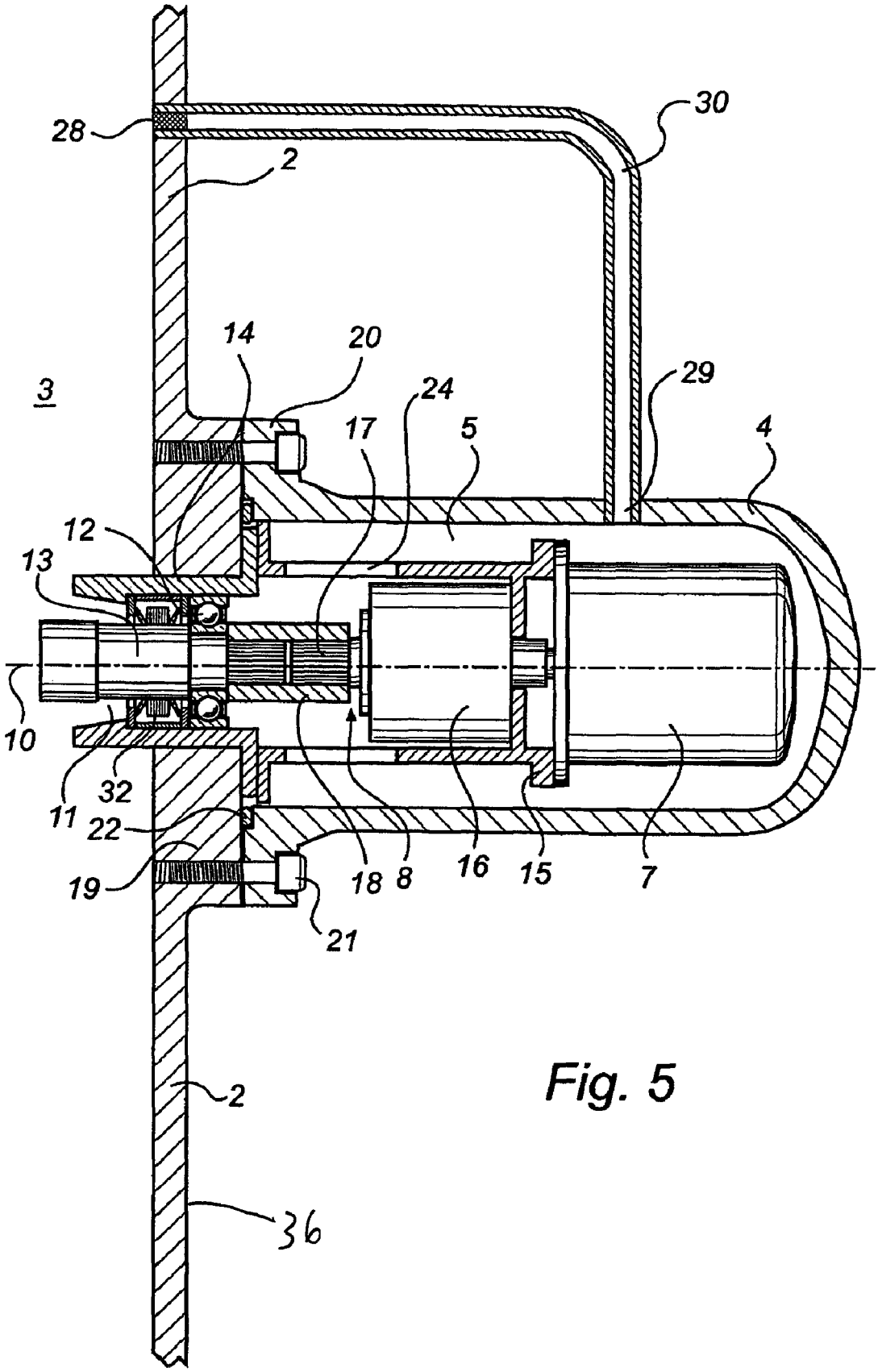
FIG. 5 is a schematic longitudinal sectional view of a driving unit compartment and portion of a treatment compartment of the cleaning machine according to a third embodiment of the invention.

In FIG. 5 a third embodiment of the cleaning machine according to an aspect of the invention is shown. In FIG. 5, those components that correspond to components shown in FIGS. 1 and 3 have the same reference numerals. The embodiment according to FIG. 5 differs from the first embodiment described above in that the fluid communication between the driving unit compartment 5 and the treatment compartment 3 is affected by a connection separate from the transmission opening 11. The fluid communication between the driving unit compartment 5 and the treatment compartment 3 is realized by a fluid communication connection including a first fluid communication opening 28 in the rear wall of the treatment compartment housing 2, a second fluid communication opening 29 in the cylindrical wall of the driving unit compartment housing 4 and a duct 30 connecting the first and second fluid communication openings 28 and 29. A shielding device, such as, for example, a filter or a seal, for reducing liquid communication between the treatment compartment and the driving unit compartment may be provided in one of the first and second fluid communication openings or transmission opening. For example, the duct 30 is provided with a filter 31 at the fluid communication opening 28. In the transmission opening 11, a substantially fluid and pressure tight sealing 32 is provided. Thus, it is possible to almost entirely prevent impurities to reach the driving unit compartment from the treatment compartment.

According to the third embodiment, in addition to the hoodlike driving unit compartment housing 4, the duct 30 has to be removed or at least disconnected from the driving unit compartment housing 4, when the driving unit compartment 5 is to be inspected. For this purpose, the duct 30 is releasably attached to the treatment compartment housing 2 and the driving unit compartment housing 4 in a fluid and pressure tight manner.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A dry cleaning machine comprising:

a fluid tight pressure vessel defined by a treatment compartment housing that defines a treatment compartment; and a driving unit compartment housing that defines a driving unit compartment configured to withstand high pressure associated with the use of densified liquid state treatment gas, wherein the driving unit compartment housing is connected to the treatment compartment housing, and the driving unit compartment and the treatment compartment are in fluid communication and have essentially the same pressure, wherein the treatment compartment housing includes a transmission opening through which a transmission arrangement extends such that a driving unit projects from the transmission opening and a wall of the treatment compartment housing, wherein the transmission opening is positioned above a maximal liquid level of the dry cleaning machine and configured such that gas flow is permitted through the transmission opening but liquid flow is not permitted through the transmission opening, and wherein the driving unit compartment housing can be removable from the treatment compartment housing to access the driving unit compartment from outside the treatment compartment without having access to the treatment compartment.

2. The cleaning machine of claim 1, wherein the treatment compartment housing includes a front wall, a back wall, and side walls, and wherein the driving unit compartment housing is connected to one wall of the treatment compartment housing such that the driving unit compartment housing covers less than half of the one wall.

3. The cleaning machine of claim 1, wherein the driving unit compartment housing has a hoodlike shape.

4. The cleaning machine of claim 1, wherein transmission opening is provided with a shielding device for reducing liquid communication between the treatment compartment and the driving unit compartment.

5. The cleaning machine of claim 1, wherein the treatment compartment housing further includes a first fluid communication opening, the driving unit compartment housing has a second fluid communication opening, and wherein the first and second fluid communication openings are connected.

6. The cleaning machine of claim 5, wherein the transmission opening is provided with a sealing that obstructs fluid communication between the treatment compartment and the driving unit compartment through the transmission opening.

7. The cleaning machine of claim 5, further comprising at least one filter provided in the connection between the first and second fluid communication openings.

8. The cleaning machine of claim 5, wherein the first and second fluid communication openings are connected via a duct.

9. The cleaning machine of claim 1, wherein the transmission opening is provided with a sealing that obstructs fluid communication between the treatment compartment and the driving unit compartment through transmission opening.

10. The cleaning machine of claim 1, further comprising:

a drum for receiving objects to be cleaned; and a driving arrangement connected to the drum and operable to rotate the drum, wherein the drum is rotatably arranged in the treatment compartment and the driving arrangement is at least partially arranged in the driving unit compartment.

11. The cleaning machine of claim 10, wherein the driving arrangement extends from the driving unit compartment into the treatment compartment through the transmission opening, and wherein a closing member, which includes the hoodlike driving unit compartment housing, is attached to the treatment compartment housing around a rim of the transmission opening with an entrance opening facing the transmission opening.

12. The cleaning machine of claim 11, wherein a support structure is provided inside the driving unit compartment, wherein at least at one side of the transmission opening is mounted to the treatment compartment housing.

13. The cleaning machine of claim 12, wherein a motor of the driving unit is mounted to the support structure.

14. The cleaning machine of claim 12, wherein a transmission arrangement of the driving unit is mounted to the support structure.

15. The cleaning machine of claim 10, wherein the drum is rotatable about an axis and wherein the driving unit compartment housing is located such that the driving arrangement is aligned with the axis.

16. The cleaning machine of claim 10, wherein the drum is rotatable around a substantially horizontal axis.

17. The cleaning machine of claim 1, wherein the fluid communication between the driving unit compartment and the treatment compartment takes place above ⅓ of the height of the treatment compartment.

18. The cleaning machine of claim 1, wherein the densified liquid state treatment gas is carbon dioxide.

19. A dry cleaning machine comprising:

a treatment compartment having a drum rotatably disposed therein;

a driving unit compartment configured to withstand high pressure associated with the use of densified liquid state treatment gas having a motor disposed therein, the driving unit compartment being coupled to a wall of the treatment compartment; and a seal provided between the treatment compartment and the driving unit compartment, wherein the motor is coupled to the drum via a rotatable shaft which extends between the treatment compartment and the driving unit compartment, the seal being positioned and configured such that gas flow is permitted and liquid flow is obstructed between the treatment compartment and the driving compartment, wherein the driving unit compartment and the treatment compartment are in fluid communication and have essentially the same pressure, and wherein the driving unit compartment can be removed from the treatment compartment such that the motor can be accessed without having access to the treatment compartment.

20. A cleaning machine including:

a treatment compartment housing having a drum rotatably disposed within a treatment compartment; and a driving unit compartment housing having a driving unit disposed therein, the driving unit compartment housing being secured to a wall of the treatment compartment housing, wherein the treatment compartment housing includes a transmission opening through which the transmission arrangement extends, wherein the transmission opening is substantially closed by a sealing ring, bearing arrangement, and drum shaft such that when the driving unit compartment housing is removed from the treatment compartment housing, the driving unit can be accessed without having access to the treatment compartment, wherein the pressure is balanced between the treatment compartment and the driving unit compartment, and wherein the transmission opening is positioned at a level above a maximal liquid level of the drying cleaning machine and configured so as to permit gas flow and obstruct liquid flow between the treatment compartment and the driving unit compartment.

* * * * *